US005268663A

United States Patent [19]

Takeuti et al.

[11] Patent Number: 5,268,663

[45] Date of Patent: Dec. 7, 1993

[54] IGNITION COIL ASSEMBLY DIRECTLY APPLIED TO IGNITION PLUG FOR INTERNAL COMBUSTION ENGINE

[75] Inventors: Yukihisa Takeuti, Aichi; Masayuki Yamaguchi, Nagoya, both of Japan

[73] Assignee: Nippondenso Co., Ltd., Kariya, Japan

[21] Appl. No.: 736,936

[22] Filed: Jul. 29, 1991

[30] Foreign Application Priority Data

Jul. 30, 1990 [JP] Japan ..... 2-202228

[51] Int. Cl.[5] ..... H01F 17/04; H01F 27/26

[52] U.S. Cl. ..... 336/212; 29/609; 336/83; 336/219; 336/234

[58] Field of Search ..... 336/212, 234, 219, 233, 336/83; 29/607, 609; 123/634

[56] References Cited

U.S. PATENT DOCUMENTS

| | | | |
|---|---|---|---|
| 352,105 | 11/1886 | Zipernowsky et al. | 336/219 |
| 1,307,867 | 6/1919 | Lee | 336/234 |
| 1,398,793 | 11/1921 | Peplinski | 336/234 |
| 1,474,152 | 11/1923 | Kent | 336/234 |
| 1,497,469 | 6/1924 | Ames | 336/234 |
| 1,641,374 | 9/1927 | Chryst | 336/234 |
| 2,682,021 | 6/1954 | Elman | 336/219 |
| 2,962,679 | 11/1960 | Stratton | 336/83 |
| 3,350,670 | 10/1967 | Strauch | 336/234 |
| 3,527,095 | 9/1970 | Wada | 336/219 |
| 4,035,751 | 7/1977 | Walthew | 336/234 |
| 4,800,356 | 1/1989 | Ellis | 336/212 |

FOREIGN PATENT DOCUMENTS

| | | |
|---|---|---|
| 0193079 | 9/1986 | European Pat. Off. . |
| 3152008 | 7/1983 | Fed. Rep. of Germany . |
| 1533644 | 6/1968 | France . |
| 2442347 | 6/1980 | France . |
| 63-132411 | 6/1988 | Japan . |
| 1-50403 | 2/1989 | Japan . |
| 2199193 | 6/1988 | United Kingdom . |

*Primary Examiner*—Thomas J. Kozma

*Attorney, Agent, or Firm*—Cushman, Darby & Cushman

[57] ABSTRACT

An ignition coil assembly to be inserted into a plug hole of an engine so as to be directly coupled to an ignition plug. The ignition coil assembly is equipped with a central iron core and primary and secondary coils wound around the central iron core. The central iron core is formed by bundling magnetic wire rods to have a cylindrical configuration. This arrangement allows the ignition coil assembly to be easily and effectively inserted into the plug hole of the engine.

11 Claims, 9 Drawing Sheets

IGNITION COIL ASSEMBLY DIRECTLY APPLIED TO IGNITION PLUG FOR INTERNAL COMBUSTION ENGINE

BACKGROUND OF THE INVENTION

The present invention relates principally to an ignition coil assembly to be arranged to be directly coupled to an ignition plug for internal combustion engines.

Such types of ignition coil assemblies generally comprise a central iron core constructed by placing silicon steel plates one upon another so as to form the outer shape to a square pole configuration such as is disclosed in the Japanese Patent Provisional Publication No. 63-132411. There is a problem which arises with the aforementioned conventional ignition coil assembly comprising the central iron core with a square pole configuration, however, in that difficulty can particularly be encountered to encase it in a space such as a cylindrical plug hole for insertion of the ignition plug.

SUMMARY OF THE INVENTION

It is therefore an object of the present invention to provide an ignition coil assembly which is capable of being effectively and easily inserted into a small cylindrical space such as the plug hole for insertion of an ignition plug.

In accordance with the present invention, there is provided an ignition coil assembly for an internal combustion engine, comprising a central iron core formed by bundling magnetic wire rods to have a cylindrical configuration and processing them under a pressure, and primary and secondary coils wound around the central iron core.

Preferably, the wire rods are made of a material whose magnetic flux density is equal to or above 1.3 tesla when magnetic field is 8 oersted, and the wire rods are bundled to form the cylindrical central iron core so that the space factor is above 52.5%. Further, an insulating layer is attached to a circumference of each of said wire rods, and said wire rods with said insulating layers are bundled and pressed to be closely attached to each other to form the cylindrical central iron core, so that the space factor of the wire rods is 85 to 95%. It is also preferable that each of the wire rods has a diameter of 0.01 to 3 mm and has a hexagon cross section due to the pressure formation performed when bundling said wire rods to have a cylindrical configuration. Gaps formed between the wire rods which are presented at a peripheral portion of the central iron core are filled with a resin including magnetic metal powder. The central iron core is formed by placing the cylindrically bundled wire rods in a silicon steel pipe and then compressing said silicon steel pipe against the cylindrically bundled wire rods. The silicon steel pipe has slits formed by axially cutting it, and said slits are filled with an insulating material.

In accordance with the present invention, there is further provided an ignition coil assembly to be inserted into a plug hole of an engine so as to be directly coupled to an ignition plug, the ignition coil assembly comprising a central iron core formed by bundling magnetic wire rods to have a cylindrical configuration, and primary and secondary coils wound around the central iron core, the wire rods being made of a material whose magnetic flux density is equal to or above 1.3 tesla when magnetic field is 8 oersted, and an insulating layer being attached to each of the wire rods, and the central iron core being formed so that the space factor of the wire rods with said insulating layers is 85 to 95%.

BRIEF DESCRIPTION OF THE DRAWINGS

The object and features of the present invention will become more readily apparent from the following detailed description of the preferred embodiments taken in conjunction with the accompanying drawings in which.

DETAILED DESCRIPTION OF THE INVENTION

Figure 1:
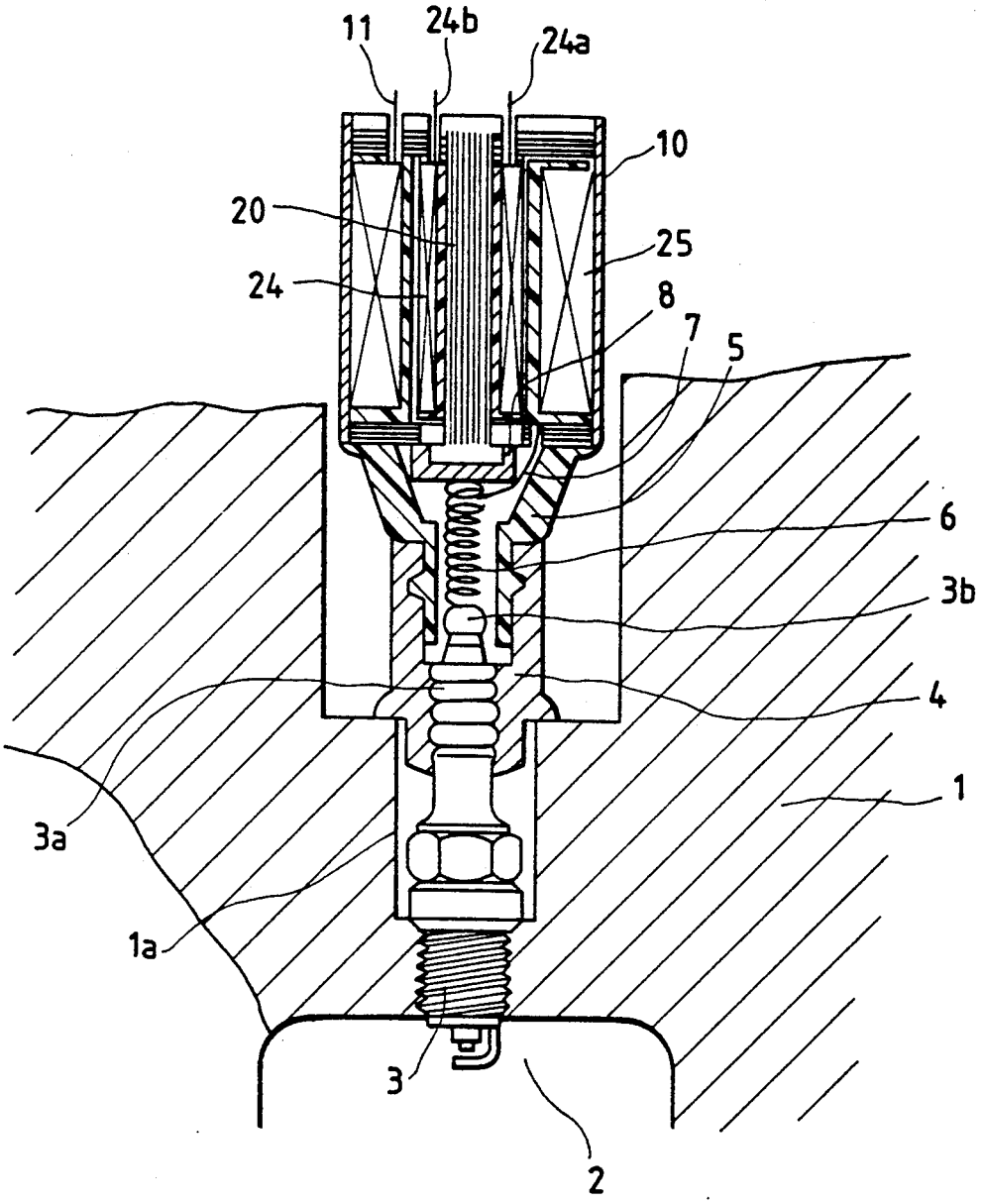
FIG. 1 is a cross-sectional view showing an ignition coil assembly according to the present invention which is attached to an engine.

FIG. 1 is a schematic illustration where an ignition coil assembly 10 is mounted in the inside of an engine. In FIG. 1, numeral 1 represents an engine block, 2 designates a fuel chamber formed in the engine block 1, 3 depicts an ignition plug inserted and fixed in a plug hole 1*a* of the engine block 1, 4 denotes a cylindrical rubber one end portion of which is tightly engaged with an insulator 3*a* portion of the ignition plug 3, and 5 indicates a cylindrical tower member for insulating the top portion of the ignition coil assembly 10, the top portion of the cylindrical tower member being tightly engaged with the other end portion of the cylindrical rubber 4. Further, illustrated at numeral 6 is a electrically conductive spring which is for introducing the secondary generation voltage of the ignition coil assembly 10 into an electrode 3*b* provided at the upper end portion of the ignition plug 3 and which is placed in the tower member 5. Numeral 7 is a lead wire for leading the secondary voltage developed by a secondary coil 25 of the ignition coil assembly 10 to the conductive spring 6. Still further, illustrated at numeral 8 is an insulating fixing base for fixing the conductive spring 6 so as to be kept in the tower member 5. 24*a* and 24*b* are lead wires for leading electricity to a primary coil 24 of the ignition coil assembly 10, and 11 is an earth side lead wire for the secondary coil 25.

Figure 2A:
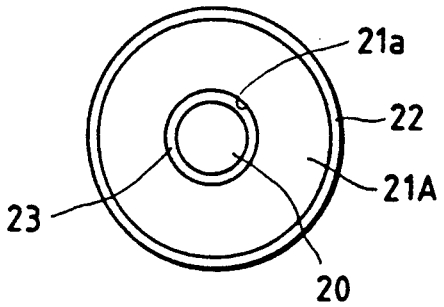
FIGS. 2A to 2C are illustrations of an arrangement of an ignition coil assembly according to an embodiment of the present invention.
Figure 2B:
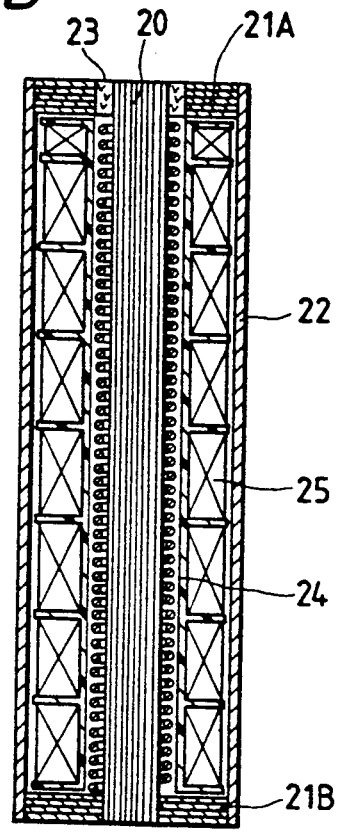
Figure 2C:
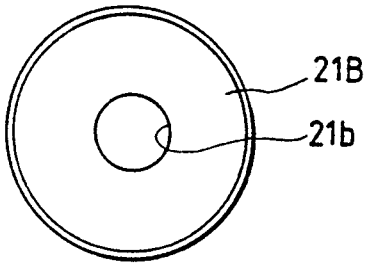

FIGS. 2A, 2B and 2C show an arrangement of a principal portion of the ignition coil assembly 10. In FIGS. 2A to 2C, numeral 20 represents a central iron core formed by bundling wire rods so as to have a cylindrical (circular-pole-like) configuration, 21A and 21B are disc-like members for magnetic paths which are disposed at both ends portions of the central iron core 20 and which are arranged to have at their centers, holes 21*a* and 21*b* respectively engageable with the central iron core 20, 22 denotes an outer cylindrical magnetic-path member, and 23 designates a cylindrical (or plate-like) magnet inserted into a magnetic gap between the disc-like magnetic-path member 21A and the central iron core 20. The primary coil 24 and secondary coil 25 are respectively wound around the central iron core 20. Here, the magnet 23 is for applying a bias magnetic flux to a closed magnetic path comprising the central iron core 21, disc-like magnetic-path members 21A, 21B and outer cylindrical magnetic-path member 22 so as to improve the generation voltage of the secondary coil 25. A neodymium magnet or rare earth magnet may be used for the magnet 23. Further, as the central iron core 20 there is used an assembly constructed by bundling wire rods manufactured in accordance with a manufacturing method (FIG. 3) which will be described hereinafter. At the periphery of the central iron core 20 there is provided the primary and secondary coils 24 and 25. The magnetic field generated by the primary coil 24 goes to the disc-like (silicon steel plate) magnetic-path member 21B, disposed at one end portion, and then returns to the central iron core 20 after passing through the outer cylindrical magnetic-path member 22, the disc-like magnetic-path member 21A and the permanent magnet 23. At this time, cutting off the current passing through the primary coil 24 allows generation of a high voltage in the secondary coil 25.

TEST 1

Figure 6:
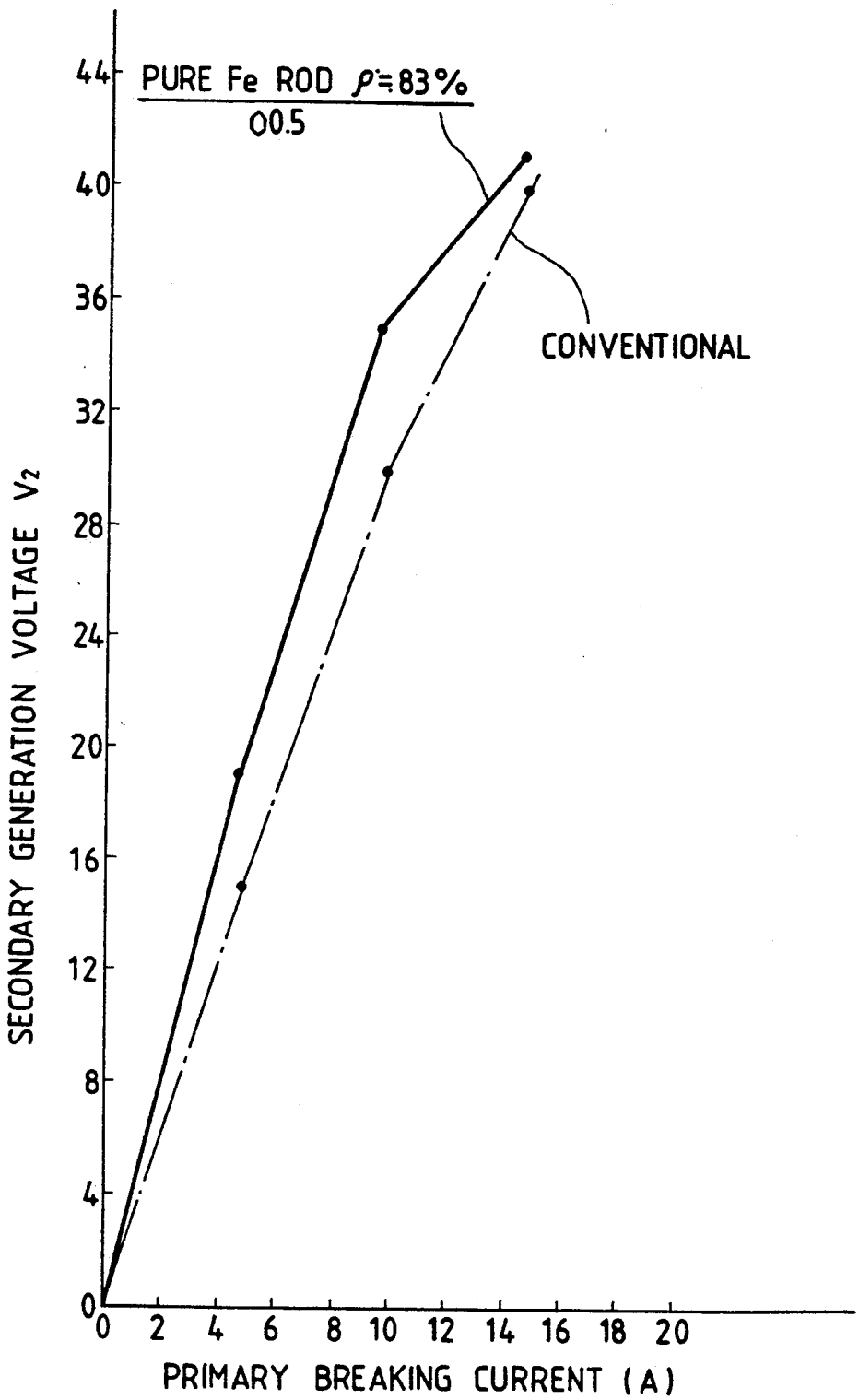
FIG. 6 shows the primary breaking current-to-secondary generation voltage characteristic of an ignition coil assembly according to this invention.

A cylindrical ignition coil 10 having an outer diameter of 22 mm and a length of 68 mm is trially produced under the condition that the number of turns of the primary coil 24 is 132 and the number of turns of the secondary coil 25 is 13200. The central iron core 20 is produced by bundling hexagon rods with a space factor of 83% so as to have a cylindrical configuration having a diameter of 7.0 mm (cross-sectional area: 38.48 $mm^2$). Each of the hexagon rods is made of a pure iron and has a diameter of 0.5 mm. FIG. 6 shows the characteristic results of this ignition coil 10. As obvious from FIG. 6, this ignition coil 10 has obtained the characteristic which is equal to or higher than a conventional ignition coil comprising a square-pole-like core (lamination of silicon steel plates; silicon steel plate lamination thickness $t=10$ mm, appearance $=47\times64$ mm, central iron core cross-sectional area $=49$ $mm^2$). That is, in this embodiment, when performing the inspection in terms of the cross-sectional area of the central iron core 20, it is possible to obtain the central iron core having a better characteristic with the cross-sectional area 38.48 $mm^2$ smaller than the cross-sectional area 49 $mm^2$ of the conventional central iron core. This is considered to be because the central iron core is constructed by using wire rods which allows easy passage of magnetic flux and is arranged to have a circular configuration.

Figure 3:
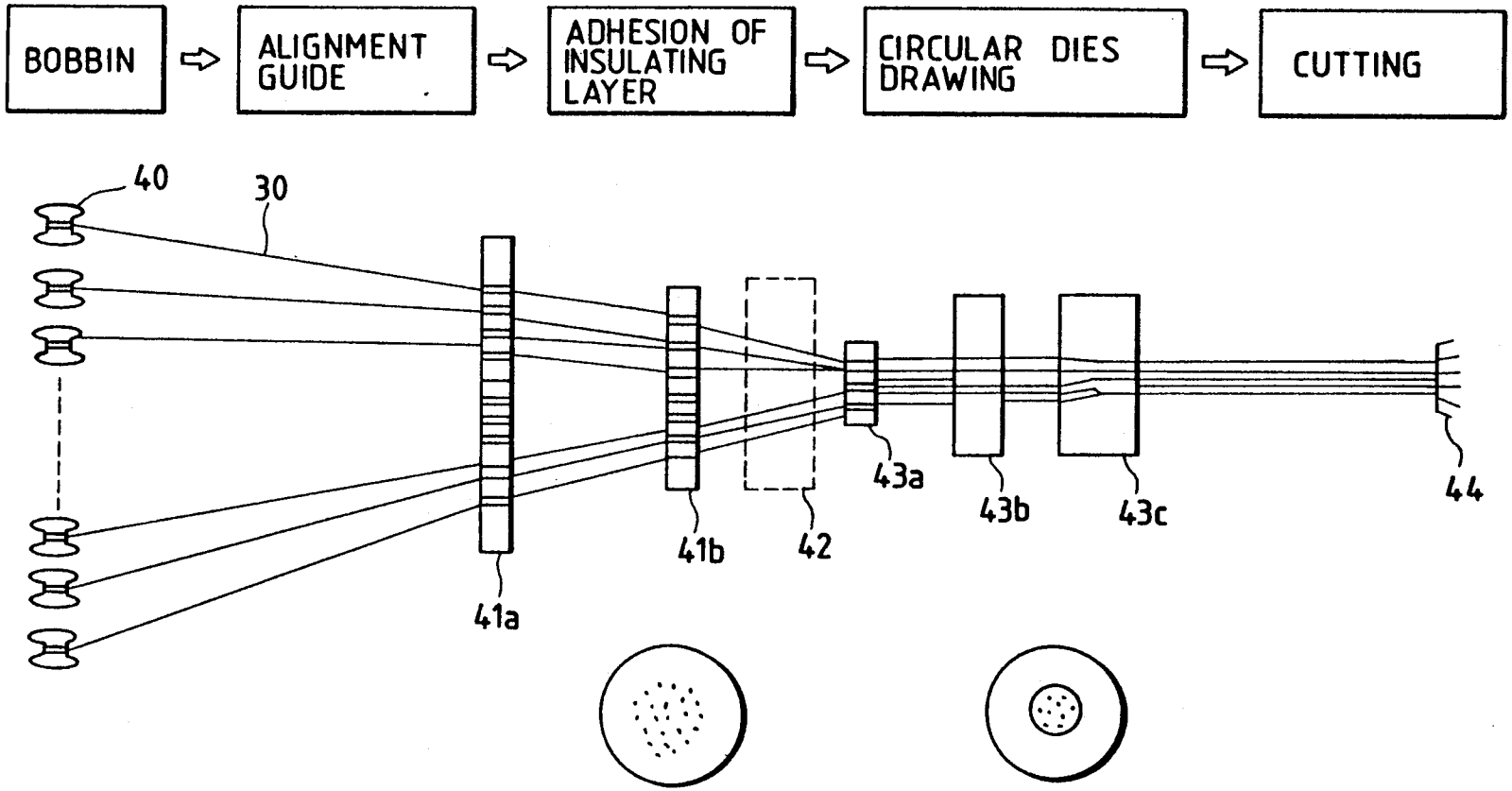
FIG. 3 is a schematic illustration for describing a method of manufacturing a central iron core of an ignition coil according to this invention.
Figure 4:
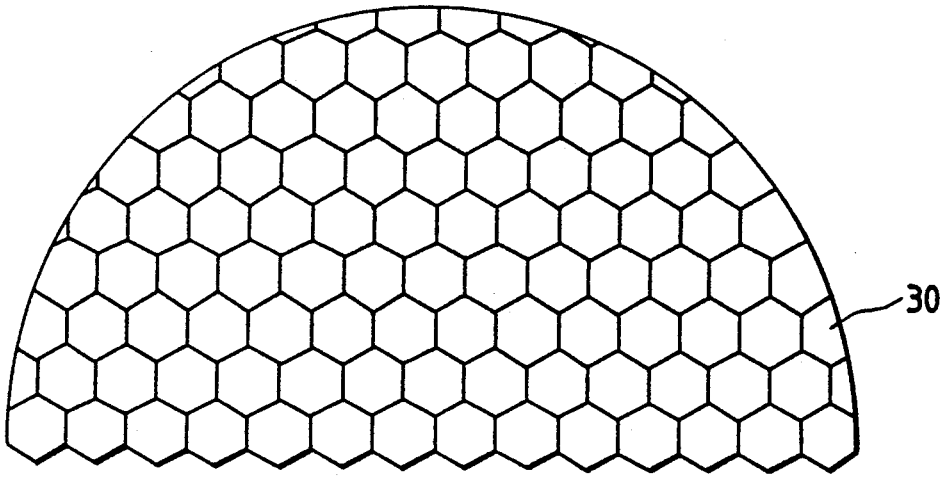
FIG. 4 is an enlarged side view showing the central iron core constructed in accordance with the manufacturing method as illustrated in FIG. 3.
Figure 5:
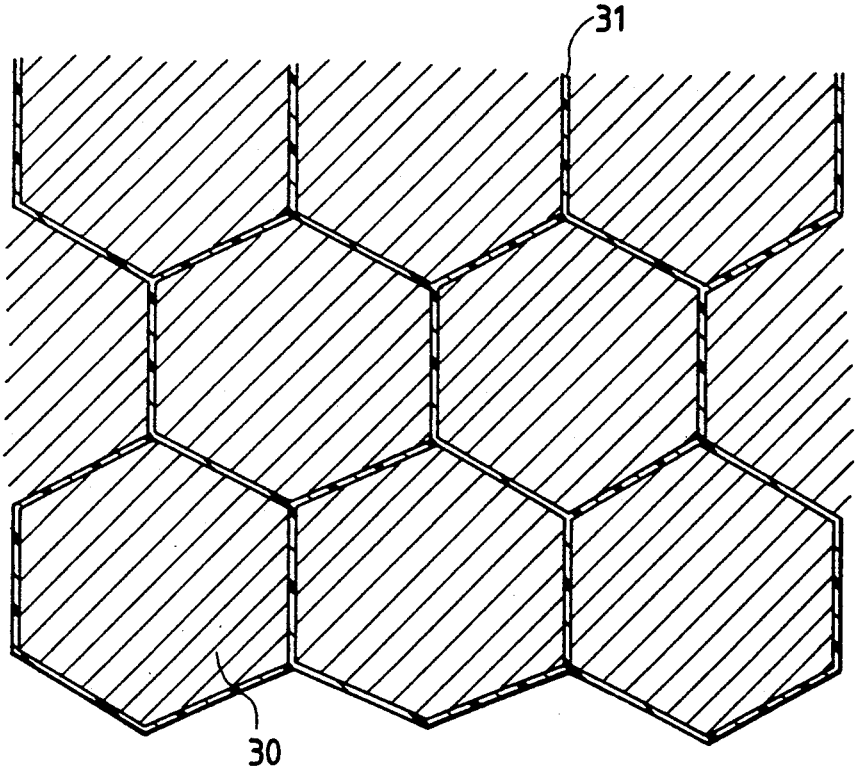
FIG. 5 is a further enlarged cross-sectional view of the FIG. 4 central iron core.

Here, a method of manufacturing the central iron core is illustrated in FIG. 3. A number of wire rods 30 are first taken up by bobbins 40 and then aligned through alignment guides 41*a* and 41*b* so that an insulating layer is attached to each of the wire rods 30 in an insulating-layer attaching process section 42. Before successively inserting them into circular dies 43*a*, 43*b* and 43*c*. Thereafter, in the circular dies 43*a*, 43*b* and 43*c*, the respective wire rods 30 are bundled and drawn so as to take a predetermined packing density to improve the space factor. Here, the end portions of the respective wire rods 30 are drawn by means of a drawing chuck 44, and the drawing tension due to the drawing chuck 44 depends upon the diameter of the wire rod 30 and the degree of the space factor. As shown in FIG. 4, the wire rod assembly bundled substantially has a hexagon configuration, and the space factor of the magnetic material in the central iron core 20 becomes above 80%. FIG. 5 shows an enlarged cross section thereof. In the case that the space factor is above 85%, insulating layers 31 are required to be placed between the respective wire rods 30. Here, as the insulating layer material there is usable any one of thermoplastic resin {for example, polyethylene (PE), polypropylene (PP), polystyrene (PS), hydrocarbon resin such as ABS resins, acrylic resins such as methyl metaacrylates (PMMA), vinyl acetate resins such as vinyl acetate resins and vinyl acetate copolymers, vinyl chlorides (PVC), vinylidene chlorides (PVDC), halogen containing resins such as fluorine, polycarbonates (PC), polyester resins such as saturated polyester (PBT), polyamide resins such as 6 nylon, 66 nylon, 11 nylon and 12 nylon, poly phenylene oxide (PPO), polyether resins such as polyacetal (POM), and poly ether ether ketone (PEEK) resins, PET resins, polyimide resins}.

Another method of manufacturing the central iron core 20 will be described. A number of wire rods 30 whose surfaces are coated with an insulating material are cut to have a predetermined length and then bundled and charged in a space formed by upper and lower dies coated with a mold lubricant so that the appearance of the product has a circular configuration, before performing the press formation with heating from the external.

TEST 2

Figure 7:
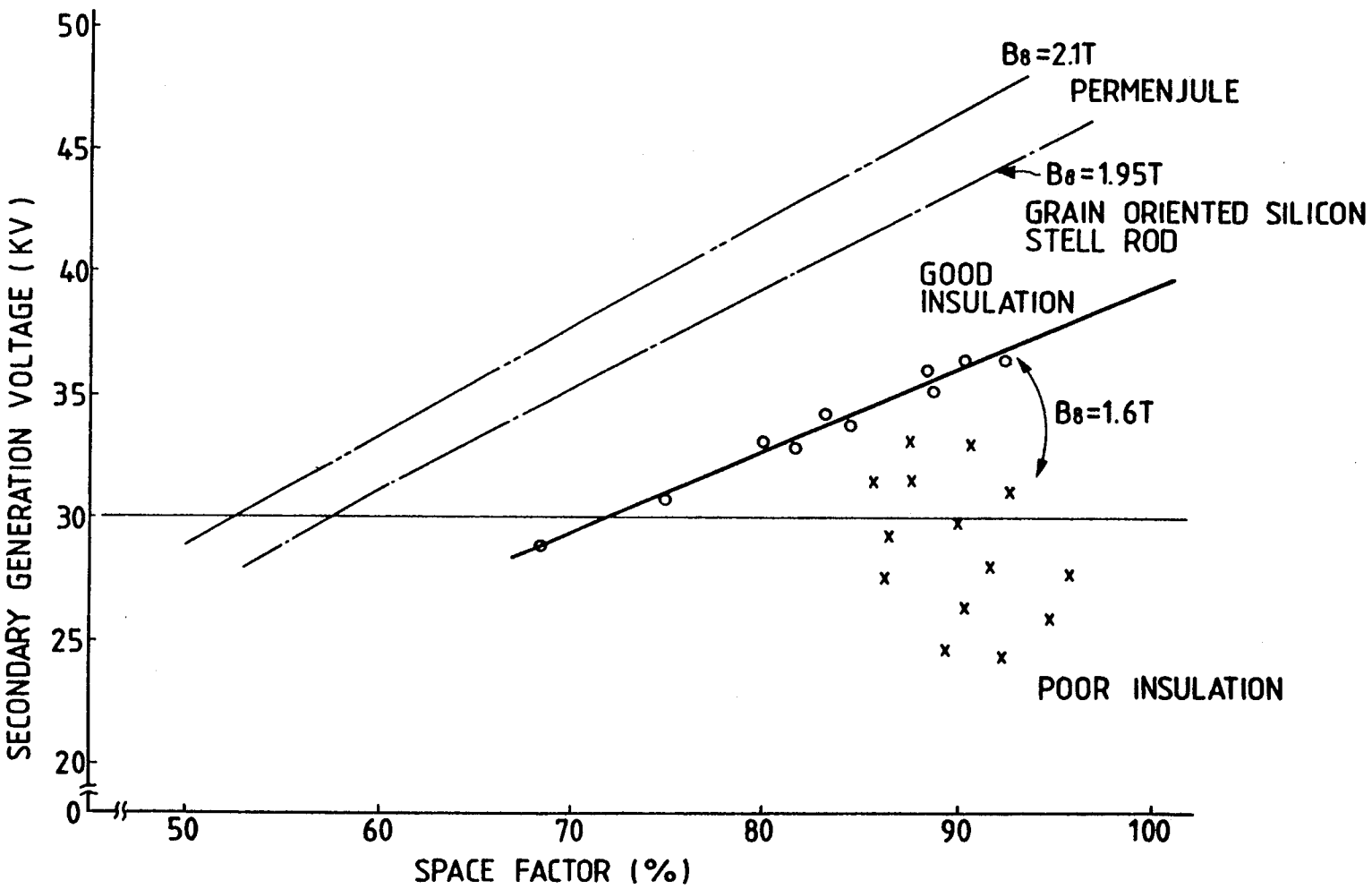
FIG. 7 illustrates the space factor-to-secondary generation voltage characteristic of an ignition coil assembly according to this invention.
Figure 8A:
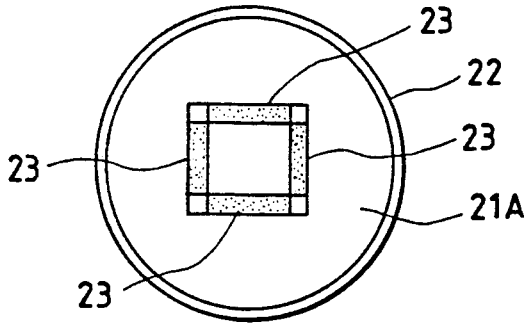
FIG. 8A is a plane view showing an ignition coil assembly according to another embodiment of the present invention.
Figure 8B:
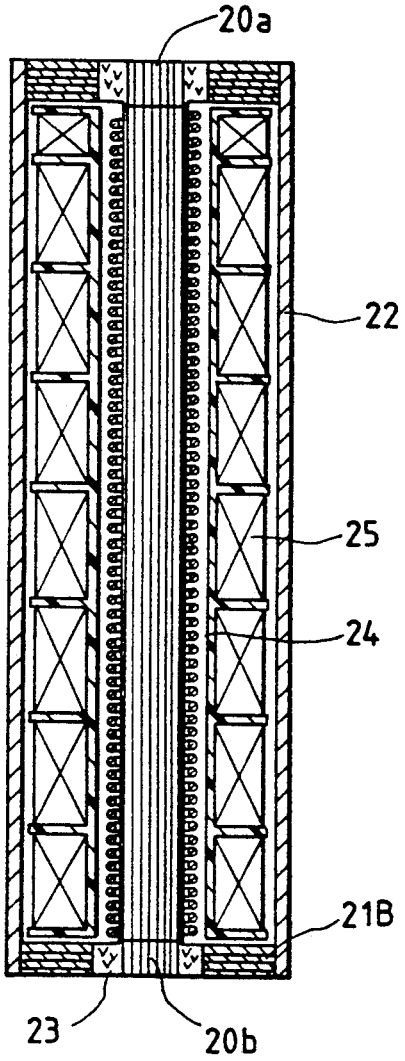
FIG. 8B is a vertical cross-sectional view of the FIG. 8A ignition coil assembly.
Figure 9B:
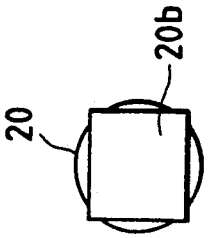
FIGS. 9A to 9D show an central iron core of the FIGS. 8A and 8B ignition coil, FIG. 9A being an elevational view, FIG. 9B being right-side view, 9C being a cross-sectional view taken along a line B-B', and FIG. 9D being a cross-sectional view taken along a line A-A'.
Figure 9A:
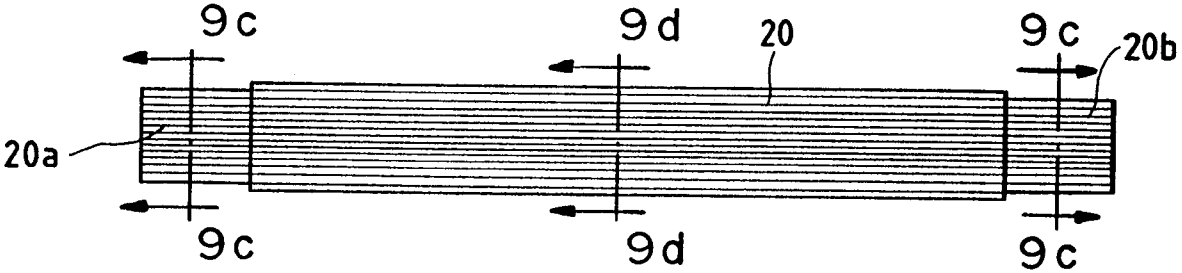
Figure 9D:
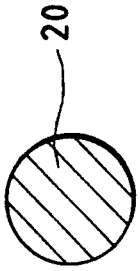
Figure 9C:
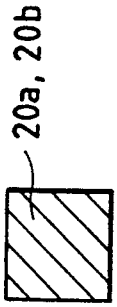

A cylindrical ignition coil having an outer diameter of 22 mm and a length of 68 mm is trially produced where the diameter of the central iron core 20 is 8.0 mm, the number of turns of the primary coil 24 is 132 and the number of turns of the secondary coil 25 is 13200. Here, in the case that the wire rods for the central iron core 20 are made of an iron with a little carbon content and arranged to have a diameter of 0.5 mm to take a magnetic flux density $B_8=1.6$ T (tesla) when the magnetic field is 8 oersteds, a portion where the secondary generation voltage becomes above 30 KV when the primary coil breaking current is 10 A is illustrated in FIG. 7. As obvious from FIG. 7, when improving the space factor of the wire rods 30 of the central iron core 20 up to above 85%, the generation voltage is lowered as illustrated by the X-mark if the insulation is insufficient. The insulation process is required for the region that the space factor is above 85% (in the case that the space factor is below 85%, there are spaces irrespective of no insulation process, thereby allowing the insulation).

Furthermore, the diameter of the wire rods 30 is preferable to be smaller (little deterioration at high frequency), while, in the case of being below 0.01 mm, when improving the space factor under the condition of the execution of the insulation process of the wire rods 30, difficulty is actually encountered to obtain the more-than 95%. In addition, when the diameter of the wire rods 30 is small, the number of the wire rods to be bundled becomes large for forming the central iron core 20 having a predetermined diameter, which results in being complex in the process, increasing the cost and making easy the breaking of the wire rods 30 on bundling. Moreover, when the diameter of the wire rods 30 becomes above 3 mm, an eddy current occurs in the wire rod so as to lower the secondary generation voltage. Preferably, each of the wire rods made of a grain oriented silicon steel has a diameter of 0.01 to 3 mm and the magnetic flux density $B_8$ is 1.95 T (tesla) under the condition that the magnetic field is 8 oersteds. In this case, as shown in FIG. 7, the space factor above 57.5% allows the secondary generation voltage above 30 KV. Similarly, in the case of the wire rods made of a permenjule (Fe compound including 50% Co), the space factor becomes above 52.5% when $B_8=2.1$ T. Thus, when the saturated magnetic flux density is great and the insulation between the respective wire rods is satisfied, it is possible to obtain a high secondary generation voltage.

Here, the secondary generation voltage V is made in accordance with the following equation (1)

$$V = k \cdot S \cdot B \cdot \rho \cdot A \cdot \left[ 1 + \frac{A'}{A} \right] \quad (1)$$

where

S: cross-sectional area

B: magnetic flux density of the material $\rho$: space factor

A: primary breaking current value

A': eddy current value k: constant

In this case, the eddy current A' becomes greater in accordance with increase in the diameter of the wire rod, and tends to become greater with no insulation. A preferable diameter of the wire rod is below 2 mm. However, in the case that the diameter of the wire rod is below 10 microns, the surface area of the wire rod becomes wide to require an insulating coat. The much insulating coat requirement reduces the space factor of the wire rod material (the ratio of the material in the cross-sectional area). The test result based upon this fact is shown in FIG. 7.

Regarding the type of wire rods 30, it is possible to use any one of materials which has a great saturated magnetic flux density and a good soft magnetic characteristic. At this time, for example, in the case of using a iron with a little carbon content (magnetic flux density is equal to or above 1.6 (tesla) under $B_8$) which has a diameter of 0.5 mm and a length of above 60 mm, it is preferable that the space factor of the wire rods is above 73% and the electrical insulation resistance between the respective wire rods is above 5 Ωcm.

That is, magnetic flux (in $B_8$); material above 1.30 T (tesla)

diameter of wire rod; 0.01 to 3 mm (circular or angular configuration)

Insulation; required (here, not required in the case that the space factor is below 85%)

space factor; while depending on the magnetic flux density value in $B_8$, it is preferable to be above about 52.5% (although a large space factor is preferable to reduce the dimension of the central iron core 20, the space factor is preferably 85 to 95% when taking into account the insulation characteristic between the wire rods 30)

FURTHER EMBODIMENT (a)

This embodiment is shown in FIGS. 8A, 8B and 9A to 9D. In this embodiment, the central iron core 20 formed by bundling wire rods to have a circular-pole-like configuration is arranged so that both end portions 20*a* and 20*b* thereof respectively have square configurations. Forming both the end portions 20*a* and 20*b* to square configurations allows that angular plane magnets which are cheaper in cost than the cylindrical magnets are provided at the four or three sides of each of both the end portions 20*a* and 20*b* and further gaps between the magnets 23 and the end portions 20*a*, 20*b* are reduced so as to reduce the leakage of the magnetic flux to improve the performance.

FURTHER EMBODIMENT (b)

Figure 10:
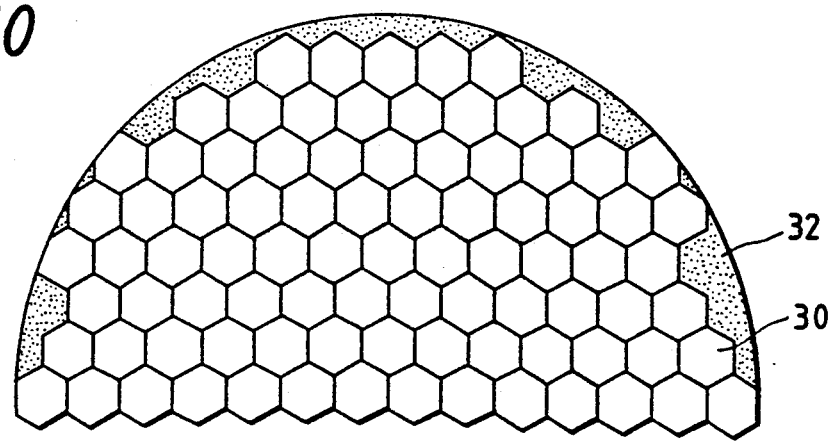
FIGS. 10 to 12 are side views showing central iron cores of ignition coil assemblies according to further embodiments of the present invention.

According to this embodiment, as illustrated in FIG. 10, after aligning hexagon wire rods 30, a material 32 in which resin powder (0.5 to 30 weight %) is attached to a surface of metallic power (pure iron or iron including silicon) is provided at the circumference of the aligned hexagon wire rods 30 and then encased in a die having a predetermined configuration so as to be pressed and further placed as it is for one to five hours under the temperature atmosphere of 150° to 300° C. so as to harden the aforementioned resin powder material (for example, araldite resin, epoxy resin). Thus, the metallic powder is charged in gaps between the hexagon wire rods which are presented at the peripheral portion. This charging (packing) efficiency reaches above 90%, thereby improving the characteristic.

FURTHER EMBODIMENT (c)

Figure 11:
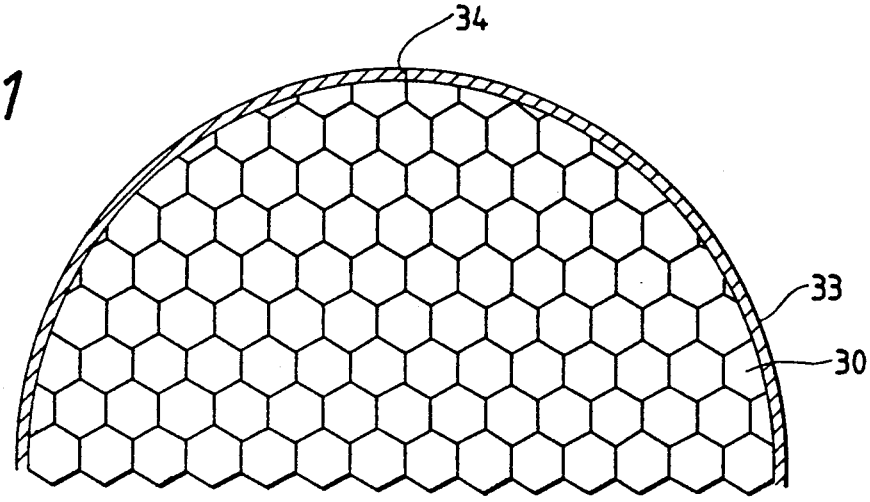

According to this embodiment, as illustrated in FIG. 11, wire rods 30 such as circular rods, triangular rods, square rods and hexagon rods are placed in a silicon steel pipe 33 and then heated in a temperature range of 300° to 900° C. so as to repeatedly perform the warm drawing operation several times using dies with different diameters in order to gradually reduce the outer diameter of the silicon steel pipe 33. With this operation, the respective wire rods 30 are pressed by means of the contracting force from the external through the silicon steel pipe so as to increase the packing density. At this time, the insulating process (the attachment process of $SiO_2$ or $Al_2O_3$, or the insulating process due to the oxide such as the oxide of iron) is effected between the respective wire rods 30. After this insulating process, in order to eliminate the eddy current which can occur in the circumferential direction, a portion of the silicon steel pipe 30 is axially cut off and an insulating material 34 is introduced into slits formed by the cutting and fixed therein. The amount of the silicon of the silicon steel pipe 33 to be used herein is 0.5 to 6 weight % and the remaining is Fe or Fe-based material. The thickness thereof is 0.1 to 0.5 mm, preferably 0.25 to 0.4 mm, and the surface of the silicon steel pipe 33 is oxidation-treated. Accordingly, the space factor becomes above 90% which provides an excellent characteristic.

ANOTHER EMBODIMENT (d)

Figure 12:
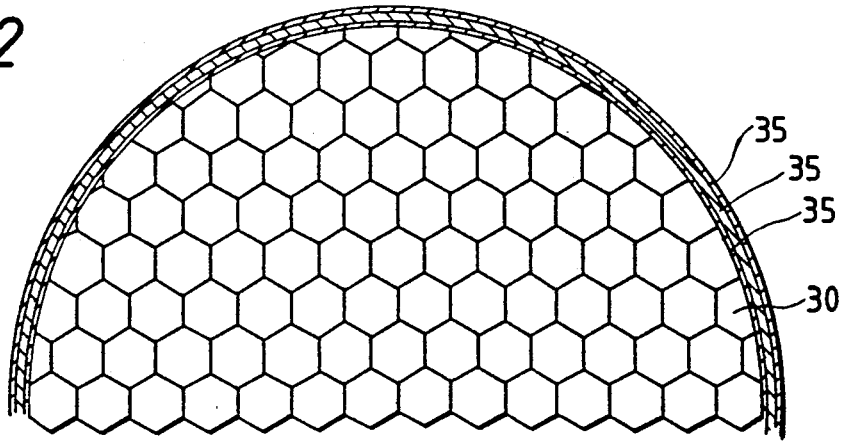

This embodiment has an arrangement as illustrated in FIG. 12. A thin silicon steel plate 35 (having a thickness of 0.1 to 0.3 mm) is wound two or three times around wire rods 30 and then drawn in a die so as to apply a pressing force to the wire rods 30 through the thin plate, thereby producing a formation to improve the space factor. At this time, the silicon steel plate 35 is insulation-processed. Although the overlapping degree of the silicon steel plate 35 increases in accordance with the contraction of the outer diameter thereof, since the silicon steel plate 35 is insulated at a portion on the circumference, it is possible to suppress generation of the eddy current. This can keep the space factor to above 90% to provide a good characteristic.

It should be understood that the foregoing relates to only preferred embodiments of the present invention, and that it is intended to cover all changes and modifications of the embodiments of the invention herein used for the purposes of the disclosure, which do not constitute departures from the spirit and scope of the invention.

What is claimed is:

1. An ignition coil assembly for an internal combustion engine, comprising:

a central iron core formed by linearly bundling magnetic wire rods along an axis so as to have a cylindrical configuration, each of said wire rods having a diameter of 0.01 to 3 mm and has a hexagonal cross section due to the pressure formation when bundling said wire rods to have a cylindrical configuration, primary and secondary coils wound around said central iron core, said wire rods being made of a material having a magnetic flux density equal to or above 1.3 tesla when a magnetic field is 8 oersted, and an insulating layer attached to a circumference of each of said wire rods, said wire rods with said insulating layers being bundled and pressed to be closely attached to each other to form said cylindrical central iron core, so that the space factor of said wire rods is 85 to 95%.

2. An ignition coil assembly for an internal combustion engine, comprising:

a central iron core formed by bundling magnetic wire rods so as to have a substantially cylindrical configuration, said rods being processed under a pressure, primary and secondary coils wound around said central iron core, said wire rods being made of a material having a magnetic flux density equal to or above 1.3 tesla when a magnetic field 8 is oersted, said wire rods being bundled so that the space factor is above 52.5%, both end portions of said central iron core being arranged to have square cross sections, and a plurality of angular plane magnets being separately provided on plane portions of both said end portions of said central iron core.

3. An ignition coil assembly as claimed in claim 1, wherein gaps formed between said wire rods which are presented at a peripheral portion of said central iron core are filled with a resin including magnetic metal powder.

4. An ignition coil assembly as claimed in claim 1, wherein said central iron core is formed by placing the cylindrically bundled wire rods in a silicon steel pipe and then compressing said silicon steel pipe against the cylindrically bundled wire rods.

5. An ignition coil assembly as claimed in claim 4, wherein said silicon steel pipe has slits formed by axially cutting it, and said slits are filled with an insulating material.

6. An ignition coil assembly as claimed in claim 1, wherein said central iron core is formed by winding a thin silicon steel plate several times around the cylindrically bundled wire rods under a pressure.

7. An ignition coil assembly for an internal combustion engine, comprising:

a central iron core formed by linearly bundling magnetic wire rods along an axis so as to have a cylindrical configuration, said cylindrical central iron core being arranged so that both end portions thereof have square cross sections, and a plurality of angular plane magnets being separately provided on plane portions of said end portions of said central iron core, primary and secondary coils wound around said central iron core, said wire rods being made of a material having a magnetic flux density equal to or above 1.3 tesla when a magnetic field is 8 oersted, and an insulating layer attached to a circumference of each of said wire rods, said wire rods with said insulating layers being bundled and pressed to be closely attached to each other to form said cylindrical central iron core, so that the space factor of said wire rods is 85 to 95%.

8. An ignition coil assembly adapted to be inserted into a plug hole of an engine so as to be directly coupled to an ignition plug, said ignition coil assembly comprising:

a central iron core formed by linearly bundling magnetic wire rods along an axis so as to have a substantially cylindrical configuration, said cylindrical central iron core being arranged so that both end portions thereof have square cross sections, and a plurality of angular plane magnets being separately provided on plane portions of said end portions of said central iron core, primary and secondary coils wound around said central iron core, said wire rods being made of a material having a magnetic flux density equal to or above 1.3 tesla when a magnetic field is 8 oersted, and an insulating layer attached to each of said wire rods, said central iron core being formed so that the space factor of said wire rods with said insulating layers is 95 to 95%.

9. An ignition coil assembly as claimed in claim 2, wherein each of said wire rods has a diameter of 0.01 to 3 mm and a substantially hexagonal cross section, said central iron core being formed by bundling said wire rods and pressing them under pressure.

10. An ignition coil assembly as claimed in claim 7, wherein each of said wire rods has a diameter of 0.01 to 3 mm and a substantially hexagonal cross section, said central iron core being formed by bundling said wire rods and pressing them under pressure.

11. An ignition coil assembly as claimed in claim 8, wherein each of said wire rods has a diameter of 0.01 to 3 mm and a substantially hexagonal cross section, said central iron core being formed by bundling said wire rods and pressing them under pressure.

* * * * *